United States Patent [19]

Ingendahl

[11] 4,161,098

[45] Jul. 17, 1979

[54] CLOCK HAVING A LINEAR SCALE

[76] Inventor: Kurt Ingendahl, Seefeldstrasse 152, Zurich, Switzerland

[21] Appl. No.: 662,895

[22] Filed: Mar. 1, 1976

[30] Foreign Application Priority Data

Mar. 3, 1975 [CH] Switzerland ..... 2650/75
Dec. 12, 1975 [CH] Switzerland ..... 16161/75

[51] Int. Cl.[2] ..... G04B 45/00; G04B 19/06

[52] U.S. Cl. ..... 58/2; 58/126 D; 58/127 R

[58] Field of Search ..... 58/1, 2, 125 C, 126 E, 58/127 R, 6 R, 6 A, 42.5, 125 R, 126 R, 126 C, 126 D, 148–151, 153

[56] References Cited

U.S. PATENT DOCUMENTS

| | | | |
|---|---|---|---|
| 989,290 | 4/1911 | Rhame et al. | 58/151 |
| 1,776,001 | 9/1930 | Konigsberg | 58/127 R X |
| 2,065,491 | 12/1936 | Harm | 58/126 D |
| 2,221,413 | 11/1940 | Schanz | 58/126 R |
| 2,411,597 | 11/1946 | Smith | 58/126 |
| 3,353,347 | 11/1967 | Gates et al. | 58/6 R |
| 3,587,222 | 6/1971 | Mestrovic | 58/2 |
| 3,956,879 | 5/1976 | Bailey | 58/125 R |

*Primary Examiner*—Edith S. Jackmon
*Attorney, Agent, or Firm*—Charles E. Brown

[57] ABSTRACT

A clock having at least one indicator device possessing at least one linear scale subdivided into time minutes and at least one indicator or pointer movable along the scale under the action of a drive mechanism. The indicator is followingly driven at least along a part of its path of travel at the scale along the movement of the sun during a day.

32 Claims, 20 Drawing Figures

CLOCK HAVING A LINEAR SCALE

BACKGROUND OF THE INVENTION

The present invention relates to a new and improved construction of a clock or watch or equivalent time-keeping instrument—hereinafter simply referred to as a clock—which is of the type comprising at least one linear scale subdivided into time units and at least one indicator or pointer which can be moved along the scale with the aid of a drive mechanism.

Such type clocks oftentimes are used for indicating time in conjunction with a measuring instrument possessing a linear scale. In this environment of use there is obtained the possibility of easily and clearly reading the time-dependent measurment values with such an instrument. The sections of the scale portraying 24 hours of the day of such type clock are then located along a straight line.

However, such type arrangement of the hour divisions does not correspond to the normal senses or reactions of a human being resulting from the observation of the movement of the sun throughout a day.

SUMMARY OF THE INVENTION

Hence, it is a primary object of the present invention to devise a clock or the like which is not associated with these drawbacks.

A further object of the invention is directed to a novel construction of clock which is extremely reliable and accurate in operation and comfortable to use.

Now in order to implement these and still further objects of the invention, which will become more readily apparent as the description proceeds, the clock of this development of the previously mentioned type is manifested by the features that the indicator is followingly driven at least at a part of its path of travel along the scale along the movement of the sun during a day.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
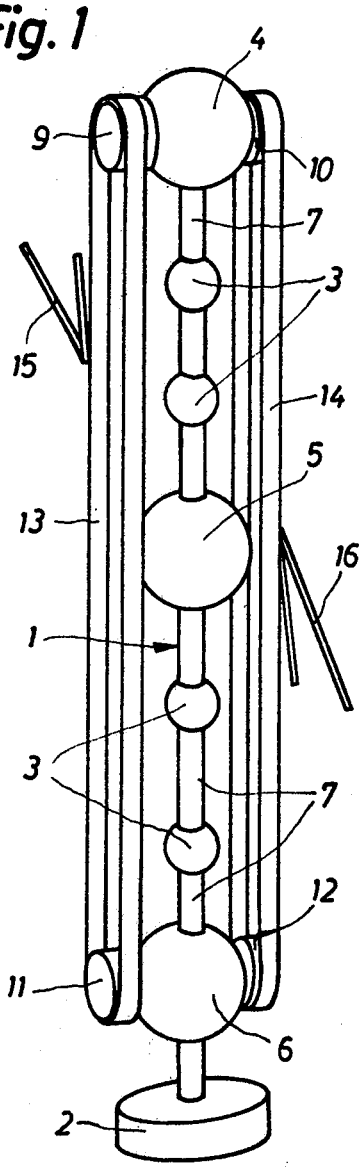
FIG. 1 is a perspective view of a first exemplary embodiment of clock constructed according to the invention.

Describing now the drawings, in the embodiment of clock shown in FIG. 1 in a ball or sphere 4 there is arranged a drive for the associated rollers 9 and 10. The drive also can be arranged in the ball or sphere 6 and act upon the rolls or rollers 11, 12. Instead of a common drive there could be provided separate drives in one of both balls 4 and 6, or also in each of these balls for the two bands 13, 14. In any event only one of both rollers of a roller pair 9, 11 and 10, 12 respectively, is however driven. Furthermore, in any event, the roller 9 or the roller 11 is driven by the drive through the agency of a transmission devive or stepdown gearing in such a manner that the band 13 during 12 hours carries out a complete cycle, i.e., moves back and forth once along the scale 1, whereas the band 14 is driven via a different transmission device by means of the roller 10 or the roller 12 at such a speed that it carries out during one hour one cycle i.e., a complete to-and-fro movement along the scale 1. Further, it is important that the bands or belts 13, 14 can be driven free of slip by the associated rollers. To this end there is possible suitably frictionally pairing the material of the flexible bands 13, 14 and the rollers. However, in order to be able to guarantee freedom of slip under all conditions the bands or belts 13, 14 are preferably constructed as toothed belts, the teeth of which coact with appropriate teeth of the rollers, such roller teeth not having been shown to simplify the illustration.

At this point there will be discussed how it is possible to read time with the clock according to FIGS. 1 and 2.

Initially there will be explained how it is possible to conceive the scale 1 starting with a dial of a conventional watch. To this end the scale 1 is conceived as the vertical diameter of a conventional watch scale which intersects the scale markings 12 and 6 (corresponding to the balls 4 and 6). There is then conceived that upon this diameter there is perpendicularly projected all scale markings of the conventional dial and then corrected such that in each instance the spacing between the projected scale markings is equal.

Figure 3:
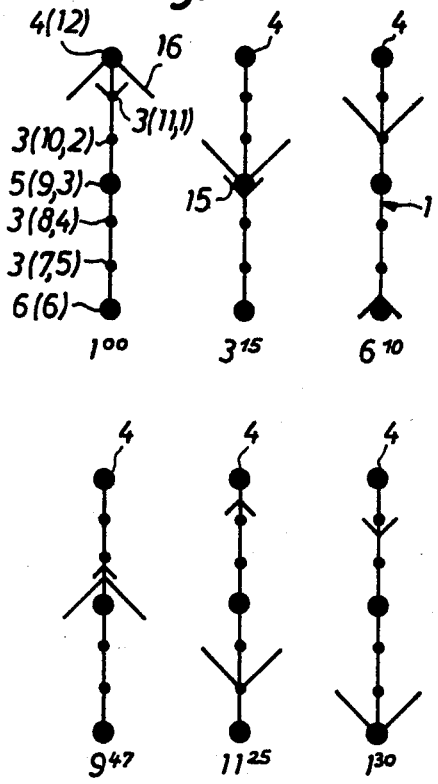
FIG. 3 illustrates six examples for the indication of time with the clock according to FIG. 1.

All of the scale markings between the end points 4 and 6 of the scale then correspond to two time values (in FIG. 3 in the left upper example the momentary associated time values of the hours are indicated in parenthesis). The scale 1 considered for itself, in comparison to the standard two dimensional circular scale, is ambiguous between both of the end points 4 and 6. The ambiguity resides in the fact that each scale marking between the end points corresponds to a value in the left semicircle and a value in the right semicircle of the conventional circular scale. This ambiguity is eliminated by means of the directional indication of the relevant indicator 15, 16. Corresponding to the usual clockwise sense the indicator namely always has a downward movement component in the right semicircle whereas it has an upward movement component always in the left semicircle. The indicators 15, 16 thus always indicate their direction of movement. The reader of the clock thus knows that with the indicator direction downwardly as in FIG. 3 the relevant time value is to be selected from the right semicircle (1, 2, 3, 4, 5 o'clock) and with movement direction upwardly there is to be selected the relevant time value from the left semicircle (7, 8, 9, 10, 11 o'clock). In this way there is eliminated the aforementioned ambiguity.

The examples of FIG. 3, wherein for control purposes there has been given in numbers the associated time, should be readily understandable in view of the above explanations.

The description of the reading of the clock has shown that the reading of the novel clock with the exception of the association of one of both time values belonging to a scale marking, proceeds with the aid of the indicator movement direction as with conventional clocks or watches. This reading, once it becomes a habit, is just as simple as with standard watches or clocks. In particular FIG. 3, but also FIGS. 1 and 2, render it evident that the clock of the invention can be read practically from all sides of a room.

Of course the scale can be formed by also projecting the scale markings of a conventional dial onto a horizontal diameter containing the time values 9 and 3. In this case only the scale end points, corresponding to the time values 9 and 3, would be unambiguous and the remaining scale markings would possess in each instance two time values, namely one from the upper semicircle and one from the lower semicircle. Also in this case it is possible to achieve the unambiguousness by the indicator movement direction: in the upper semicircle the indicator would move from the left towards the right and in the lower semicircle from the right towards the left.

The described manner of reading is equally applicable also for the minute indicator 16 which describes a complete cycle in one hour. The scale markings, like with the conventional watches, are to be considered as five minute subdivisions. If the indicator 16 moves downward, then it displays in minute value between 0 and 30 minutes and upon moving upwardly a minute value between 30 and 60 minutes.

Figure 4:
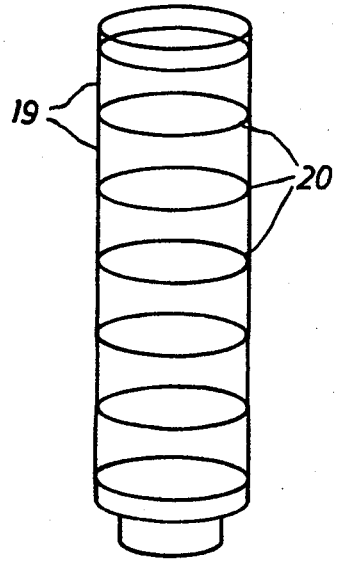
FIG. 4 is a perspective view of a modified version of the clock of FIG. 1.

FIG. 4 illustrates an exemplary embodiment where the scale is changed. The clock according to FIG. 4 comprises a cylinder of transparent material, for instance glass. In this cylinder there are arranged vertically up and down movable indicators, for instance of the construction explained in conjunction with FIGS. 1 and 2 with their drive. Here there is however no rod 1. The scale markings are in the form of circumferential or peripheral rings 20 upon the transparent cylinder which divides such into six sections 19 of equal length. Also in this case the position of the indicator arranged in the glass cylinder relative to the scale markings 20 displays the time in the same manner as explained heretofore with reference to FIG. 3.

Figure 2:
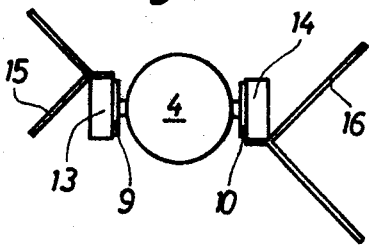
FIG. 2 is a plan view of the clock of FIG. 1.

The indicators, instead of the construction of FIGS. 1 and 2, also can be formed of liquid which is pumped into and out of the cylinder with the necessary velocity. For displaying the minutes the cylinder can concentrically contain a smaller cylinder and the outer cylinder can be filled with a liquid of a different color than the inner cylinder. It should be understood that the liquid in the "minute cylinder" must be pumped in and pumped out at twelve times the velocity of the liquid in the "hour cylinder", which in twelve hours completely fills and again empties the cylinder. Also in this case to render possible the required unambiguous reading indicators must be provided for the purpose of determining whether the liquid level drops or rises. To this end there can be provided for instance at the head of the clock special indicators, for instance containing illuminated arrows.

It should be apparent that it is within the framework of the invention if the indicators are also formed by movable luminescent points or the like. Also other indicators are conceivable if they are moved with a speed back and forth along a linear scale which is proportional to the time intervals to be measured.

Figure 5:
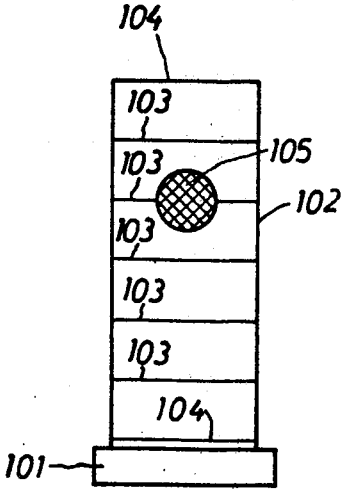
FIG. 5 is a side elevation view of a further embodiment of the clock of the present invention.

In FIG. 5 there is schematically illustrated a further embodiment of clock or the like constructed according to the invention. For this clock there is secured to a base 101 an elongate and non-transparent plate 102 possessing tranversely extending lines 103. These lines 103 together with the upper edge 104 and the lower edge 104 of the plate 102 represent markings for the indication of the time which is to be momentarily read.

An indicator 105 is mounted to be movable along the plate 102 by means of a guide device to be described more fully hereinafter and which covers the individual time markings or markers 103 and 104 or assumes a position therebetween, respectively, so that there is thus possible the reading of the momentary indicated time. The plate 102, if there is also considered the plate edges 104, is provided with seven time markers, suitable for indicating six hours. However, the time scale can also be provided with thirteen time markers for indicating twelve hours or even twenty-five time markers in order to be able to indicate twenty-four hours. If necessary, the individual time markers can also be augmented in appropriate numbers.

Assuming that the indicator 105 moves from the bottom towards the top, corresponding to the upward movement of the sun in the morning, then according to FIG. 5 it is exactly 10 o'clock since the lowermost time marker, i.e., the lower plate edge 104 in the embodiment under discussion represents 6 o'clock in the morning. Thus in the illustrated embodiment the upper plate edge 104 represents 12 noon.

Figure 6:
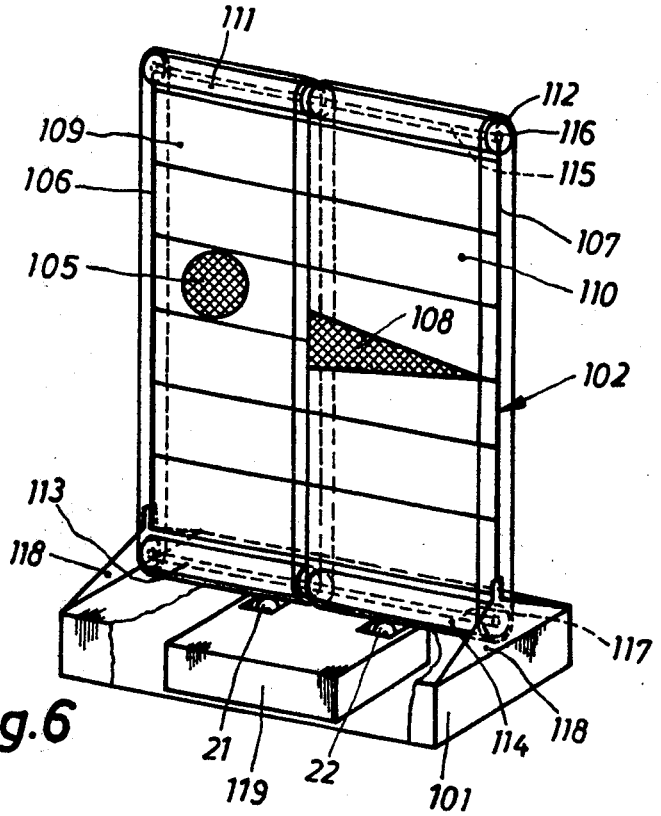
FIG. 6 is a perspective view of a further embodiment of the clock according to the invention.

In order to realize a more accurate time indication a further embodiment of the clock of this development is illustrated in FIG. 6. The scale, which again is contructed as a non-transparent plate 102, this time has two adjacently situated components 106 and 107, each of which have associated therewith an indicator 105 and 108 respectively.

In the present case under discussion the first indicator 105 is round and indicates the hours. The second indicator 108 has the shape of an arrow pointing towards the right and is intended for indicating minutes. Assuming that the minute indicator 108 likewise moves from the bottom towards the top, then the clock of FIG. 6 will show the time of 9:30.

Each of the indicators 105 and 108 is secured to a transparent band or belt 109 and 110 respectively guided at the top over deflecting rolls 111 and 112 respectively and at the bottom over drive rolls 113 and 114 respectively. The deflecting rolls 111 and 112 are freely rotatably arranged upon a common shaft 115, this shaft being supported in bearing eyelets 116 or equivalent structure at the plate 102. The drive rolls 113 and 114 for the bands 109 and 110 are likewise freely rotatably seated upon a lower common shaft 117 mounted in holder elements 118 for the plate 102. For the drive of the individual bands or belts 109 and 110 there is provided a drive device or mechanism 119 accommodated in the base 101. This drive device 119 is equipped with special output wheels 21 for the drive of the first band 109 and the second band 110. The drive device can be of random construction, whether such be held in operation by spring force, electrical currents, altering the atmospheric pressure or the like. The output wheels 21 preferably are equipped with a friction surface formed of for instance rubber which is pressed against the associated band 109 and 110. The band or belt portion clamped between the associated drive wheels 21 and the associated drive roll or roller 113 and 114 respectively, is placed into movement in this manner so that the entire indicator bands 109 and 110 are held in motion. This manner of driving the bands or belts has the advantage that the bands 109 and 110 can be driven practically free of slip.

The indicators 105 and 108 need not however only be secured to the aforementioned bands or belts 109 and 110. In many embodiments of the clock of the development it is advantageous, sometimes even necessary, to secure the relevant indicator at least at one cable traveling about deflection- and drive rolls. In such case it is then advantageous if the output wheels 21 directly bear upon the associated drive roll and the indicator cable or cables first have imparted their drive thereto from the drive roll. Such type solution is also usable for the bands or belts 109 and 110 respectively, carrying the indicators in that the drive wheels bear against the surface of the drive rolls 113 and 114, which surfaces lie free next to the edges of the bands 108 and 110.

It should be understood that the band 109 of the hour indicator 105 must be driven in such a manner that it moves through the path, corresponding to the length of the plate 102, first within six hours. The band 110 of the minute indicator 108, on the other hand, must be driven so rapidly that the minute indicator 108 moves through this path within an hour.

Hence it should be apparent that the minute indicator 108, after expiration of one hour, is displaced via the deflecting roll 112 to the rear side of the non-transparent plate 102 and can no longer be used for the indication of minutes during the next hour at the front side of the clock. It is for this reason that the band 110 is provided additionally with a second minute indicator (not shown) which first then appears at the front side of the clock when the illustrated minute indicator 109 has moved to the rear side or face of the clock. In this way there is insured for the indication of minutes during each hour at the front side or face.

Further it should be recognized that actually the same problem also arises with the hour indicator 105. It is for this reason that the band 109 carries also two hour indicators 105, the coaction of which is the same as for the minute indicators.

In many instances it can be advantageous to also provide the rear side or face of the plate 102 with the time markers or markings 103, so that it is possible to also read the relevant time from the rear side of the clock. This is particularly then advantageous if the clock is erected for instance in the center of an entrance hall of a building or in the open or the like. As will be however still more fully developed hereinafter there can be utilized the possibility of reading the time from the rear face of the relevant scale or the relevant scale portion also for further embodiments of the invention.

Figure 7:
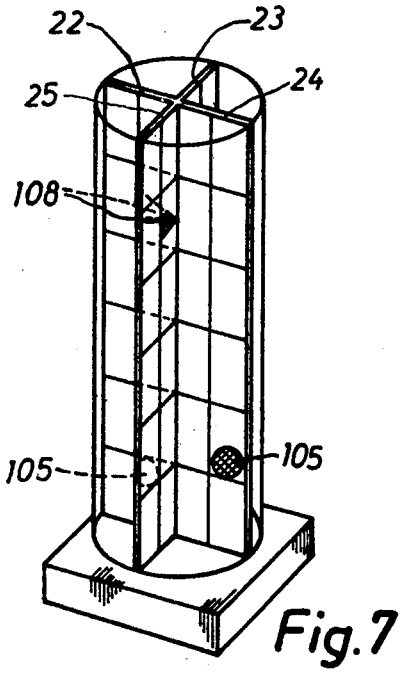
FIG. 7 is a perspective view of a clock having a crosswise arrangement of scales according to FIG. 6.

Such an advantageous possibility is shown for the embodiment of clock portrayed in FIG. 7. With this clock four two-part or bipartite scales 22, 23, 24 and 25 are grouped together into a unit and specifically in such a manner that they are oriented at right angles to one another and connected with one another along their lengthwise sides. The plan view of the four indicator units grouped together in this manner is in the form of a cross. In order to simplify the showing of FIG. 7 there have been conveniently omitted the bands or cables supporting the indicators 105 and 108 together with their deflection- and drive rolls. With such type arrangement of indicator devices the relevant time indication is read-off from the combination of the position and movement direction of always two indicators which under circumstances are located also at the neighboring scales located at right angles to one another. Assuming that in FIG. 7 the hour indicator 105 moves from the top towards the bottom and the minute indicator 108 moves from the bottom towards the top, then it is 4:55. During the next hour the minute indications are read with the aid of the minute indicator which at this moment is still located at the rear face of the right-hand scale 24 and which then appears at the top in the left portion of this scale 24.

After expiration of the first six hours there appears at the left part of the left or left-hand scale 25 at the bottom the hour indicator 105 which during the first six hours is located at the opposite face of the left scale 25 and shown in broken lines.

This clock is a so-called 12-hour clock because it is possible to read-off of this clock time data during a twelve hour interval. Of course, the remaining two scales 22 and 23 are provided with indicators in the same manner as the scales 24 and 25. Moreover, the indicators of the relevant scale of this clock are driven by the drive device in such a manner that it is possible to read the momentary time from all sides. This is possible because for instance the minute indicator 108 of the scale 22 (in FIG. 7 only shown in phantom or broken lines) is at the same height as the minute indicator 108 of the scale 25 and also moves in the same direction. Hence, it is immaterial whether during reading time the minute indicator 108 of the scale 25 or the scale 22 in conjunction with the hour indicator 105 of the scale 24 are taken into account. Since the hour indicator 105 of the scale 25 is located at the same height as the hour indicator 105 of the scale 24, the same time data can only be read-off of the scales 22 and 25. The same holds true analogously also for the scale 23 in relation to the scales 24 and 22. The drive of the indicator can be carried out in detail in the manner disclosed previously in conjunction with FIG. 6 whereby the drive rolls of the minute bands or belts are coupled with one another and those of the hour bands or belts likewise coupled with one another.

Figure 8:
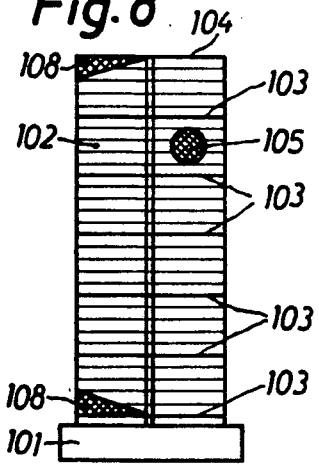
FIG. 8 is an elevational view of a further embodiment of the clock of FIG. 6.

FIG. 8 illustrates a different embodiment of the clock of FIG. 6. With this embodiment of clock the minute indicator 108 is driven in such a manner that it passes one side or face of the scale 102 once within one-half an hour. The guide means for this indicator 108, which can be a transparent band or belt or one or two cables, in this case again carries two minute indicators 108 as such has been described in conjunction with FIG. 6. Whether one is concerned with the first half of the hour or the second half of the hour is determined by the momentary position of the hour indicator 105 with regard to the time markers 103 and 104 respectively. In the illustrated embodiment the time shown is exactly 1:30. The advantage of this embodiment of the inventive clock resides in the fact that the accuracy of the minute indication can be greater with greater movement velocity of the minute indicator. For this purpose there is carried out a subdivision of the sections at the scale 102 which are located between the individual time markers 103 and 104. Indicator units wherein the minute component is only provided for one-half an hour also can be used of course with the crosswise clock construction of FIG. 7.

Figure 9:
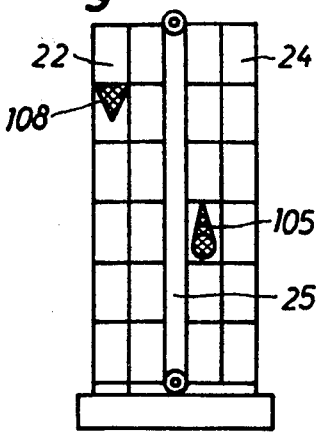
FIG. 9 is an elevational view of the clock of FIG. 8 wherein the movement direction of the individual indicators or pointers is apparent from their shape.

In FIG. 9 there is illustrated a clock which essentially corresponds to the clock of FIG. 7. The difference relative to such clock resides in the fact that from the shape of the indicator there is also apparent its direction of movement. The pointed portions of the indicators 105 and 108 are rearwardly directed so that in the illustrated embodiment the clock is showing a time of 3:55.

Figure 10:
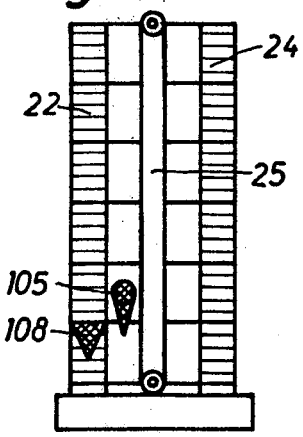
FIG. 10 is an elevational view of a clock which is similar to those illustrated in FIGS. 7 and 8.

On the other hand, FIG. 10 illustrates a clock which essentially likewise corresponds to the clock of FIG. 7, wherein however there have been undertaken the measures described in conjunction with FIG. 8. Since the minute indicator 108 of the scale 22 passes once in one-half of an hour the clock shows a time of 7:35.

There are however possible exemplary embodiments of the inventive clock wherein the indicators move over one another and thus independently of one another. The indicators advantageously travel without interruption and are for instance likewise driven by means of the drive device 119 schematically shown in FIG. 6.

Figure 11:
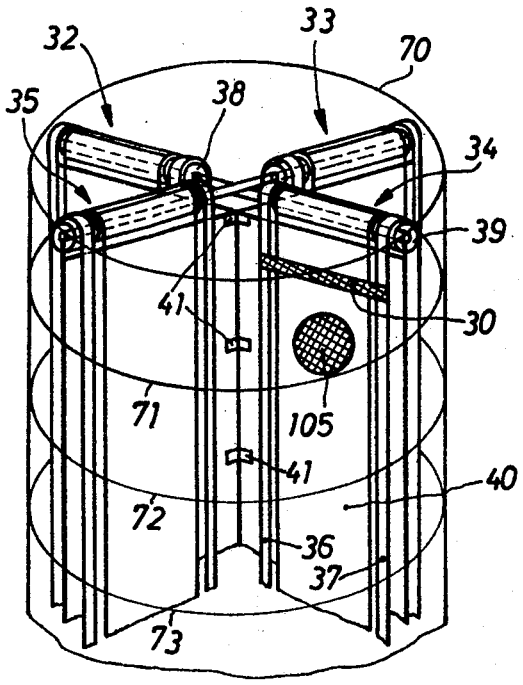
FIG. 11 is a perspective view of a further embodiment of the clock.

FIG. 11 illustrates such an embodiment of clock. The basic difference of this embodiment over the clock of FIGS. 6 and 7 resides in the fact that the minute indicator 30, which here is constructed as a strip extending transverse to the lengthwise scale 34, is carried by two cables 36 and 37 or the like at which it is connected by its ends. These cables 36 and 37 are guided at the top over deflection rollers 38 and 39 and at the bottom over corresponding drive rolls which have not been particularly shown, and which are arranged to both sides of the deflection- and drive rolls for the hour indicator band 40 and are mounted upon a common shaft therewith.

Figure 13:
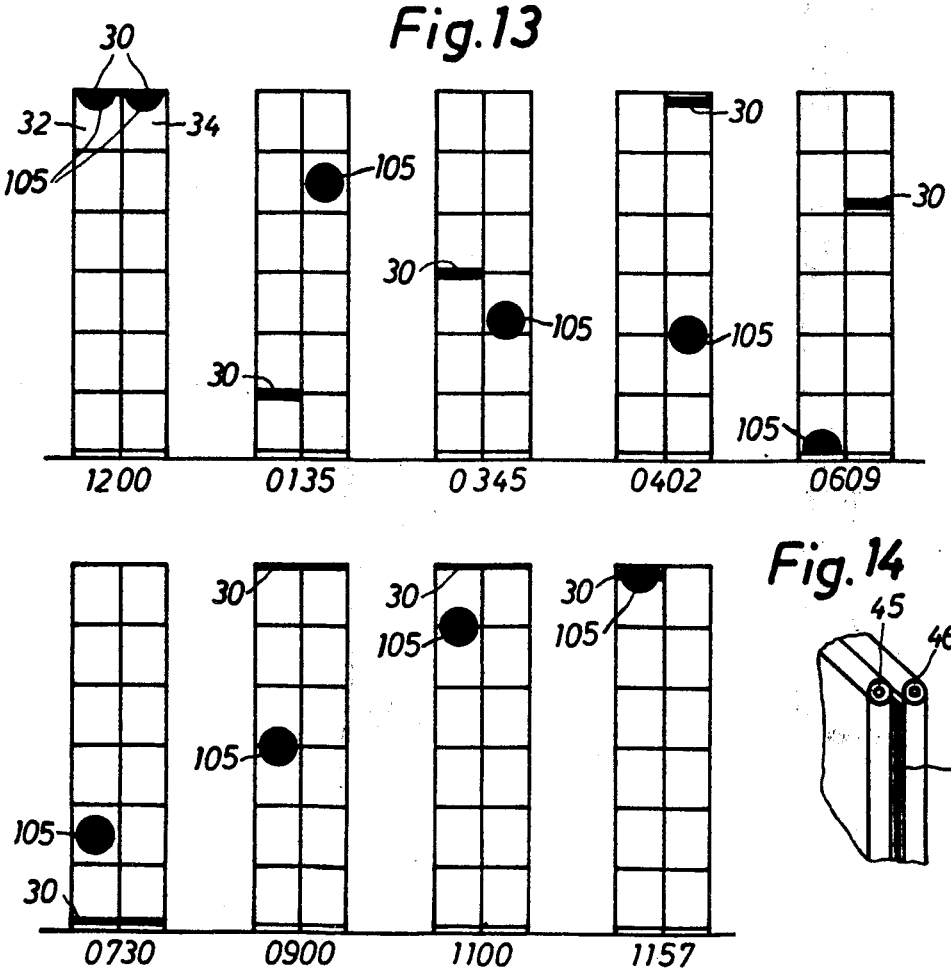
FIG. 13 illustrates a series of exemplary time indications with the clock of FIG. 11.
Figure 12:
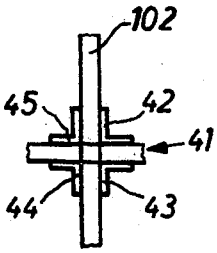
FIG. 12 is a fragmentary plan view showing a detail of the clock of FIG. 11.

According to FIG. 11 four such indicator devices or units again are grouped together into a unit or assembly, similar to the arrangement of FIG. 7. The scales 32, 33, 34 and 35 can be held together by means of clamps 41 or equivalent structure, one such clamp 41 being shown in plan view in FIG. 12. The clamp 41 has four angle-shaped portions 42, 43, 44 and 45 which are connected with one another. Between the legs of two neighboring angle elements or pieces 42 to 45 there is fixedly clamped the associated scale plate 102, as such is indicated in FIG. 12. Also in the present case the clock in question is a 12-hour clock and the relevant time data can be read-off either from two neighboring scales at right angles to one another or from two scales located in a common plane, for instance the scales 34 and 32. In FIG. 13 there are schematically illustrated nine examples for the time indications determined with the clock of FIG. 11. At the left scale 32 the minute indicator 30 moves upwards, at the right scale 34 the minute indicator 30 on the other hand moves downwards. At the left scale 32 the hour indicator 105 moves upwards and at the right scale 34 on the other hand downwards. The portrayed position of the individual indicators in the individual illustrations of this Figure present time indications which have been marked at each illustration as shown.

For particular purposes, for instance if the inventive clock is to be erected in the open, it can be advantageous to provide a transparent cylinder 70 which surrounds the indicator unit of the clock. The scale markings can be applied either to the scale plates or can be in the form of circles 71 to 73 at the jacket of the cylinder 70.

Figure 14:
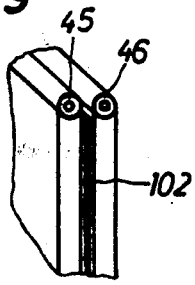
FIG. 14 is a fragmentary perspective view of a further construction of guide device for the indicator of the the clock.

In many instances it can be of advantage to construct in a special manner the drive device or mechanism of the clock. As apparent from FIG. 14 deflection rollers 45 and 46 for the bands or cables, respectively for the indicators are located to both sides of the upper end of the scale 102. In similar manner the drive rolls are arranged at the lower end of the scale 102. Consequently, the scale is located between the holder devices for the individual indicators, which can be bands, belts or cables. This exemplary embodiment of the drive device of the indicator renders it possible, as illustrated, to divide the scale into two parts, wherein the time or time data can be read both from the front side as well as from the rear side thereof. A further possibility is to have the scale only one-piece, for instance as such is illustrated in FIG. 11, and the time data again can be read both from the front side as well as also from the rear side or face of the scale.

Figure 15:
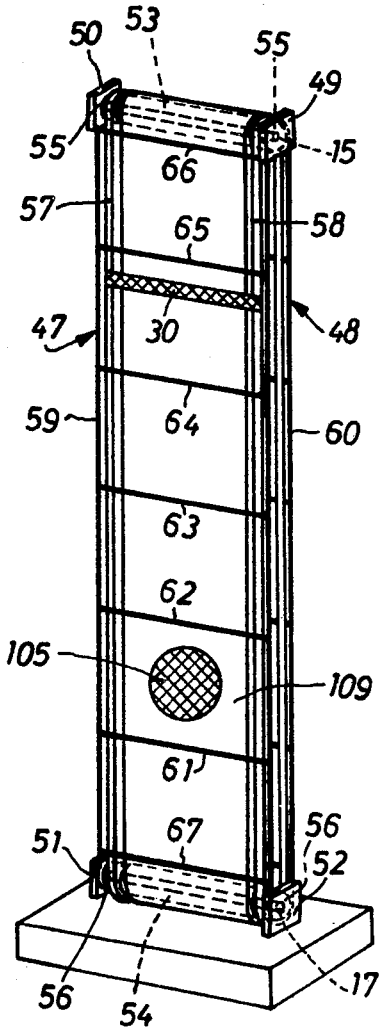
FIG. 15 is a perspective view of a still further embodiment of the clock.

A still further exemplary embodiment of the clock of the invention has been illustrated in FIG. 15 and comprises two longitudinal or elongate frames 47 and 48 constituting the scale of this clock. The two frames 47 and 48 are arranged in spaced relationship from one another and extend parallel to one another. The spacing between the frames 47 and 48 is insured for by the transverse plates 49, 50, 51 and 52 which are attached at all four corners of the scale at the frames 47 and 48. These transverse plates 49 to 52 also serve for mounting the shafts 15 and 17 upon which there are supported the deflection- and drive rolls for the indicator. The hour indicator 105 is again attached to a band or belt 109 or other equivalent structure, this band 109 being guided at the top over a deflecting roll 53 and at the bottom over a drive roll 54. Band 109 is advantageously non-transparent. It can be formed for instance of a suitable fabric. To both sides of the band rolls 53 and 54 there is seated at the relevant shaft a respective pair of deflection- and drive rolls 55 and 56, respectively, for the cables 57 and 58 of the minute indicator 30, which is constructed in the form of a strip extending transverse to the lengthwise direction of the frames 47 and 48. The longer sides 59 and 60 of the relevant frames 47 and 48 are connected with one another by means of transverse extending rods 61, 62, 63, 64 and 65 and of course also by means of the shorter frame sides 66 and 67. The mentioned transverse extending components 61 to 67 of the frames constitute time markers.

As should be apparent, the indicators 105 and 30 move along a closed path located between the frames 47 and 48 so that the indicators 105 and 30 appear behind the time markers 61 to 67. As to the showing of FIG. 11 the time indicated is 7:47.

The time indication with the present clock can be still further improved in that for the momentary hour indication there can be used two intermittently moving hour indicators.

Figure 16:
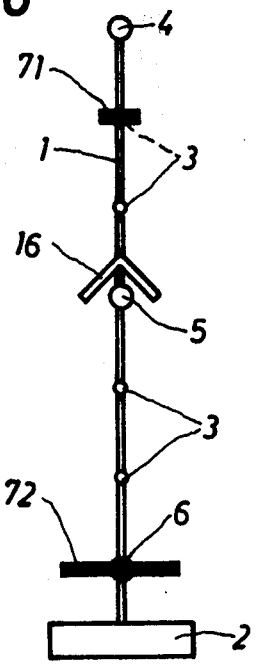
FIG. 16 is an elevational view of an embodiment of the clock of FIG. 1.
Figure 19:
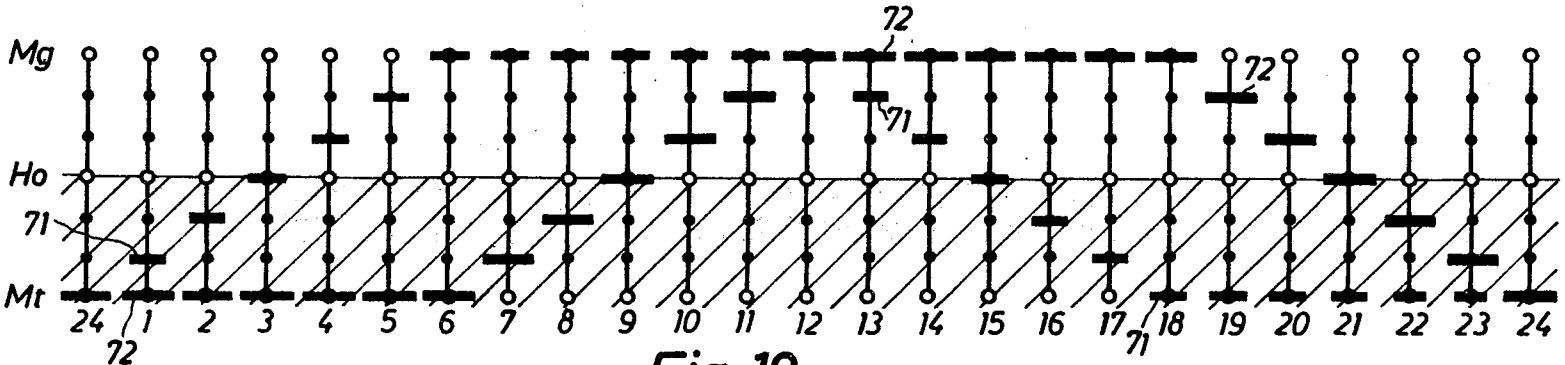
FIGS. 19 and 20 illustrate a series of exemplary indications of time with the clocks of FIGS. 16 and 18 respectively.

In FIG. 16 there is schematically illustrated a first embodiment of such type clock which essentially corresponds to the clock of FIG. 1. This clock again possesses the rod 1 secured at the base 2. The rod 1 carries the small and large balls 3 to 6. The minute indicator 16 and two hour indicators 71 and 72 are secured to non-illustrated drive belts. The minute indicator 16 moves continuously as already described. The hour indicators 71 and 72, as stated, move intermittently and specifically as follows: The first hour indicator 71, which is smaller than the second hour indicator 72, is located either next to the larger hour indicator 72 or leads the same. As best seen by referring to FIG. 19 at midnight both indicators 71 and 72 are down. Then the smaller indicator 71 moves upwards, passes over the horizontal plane Ho, until at 6 o'clock it is located completely at the top or upper position where it stops. Thereafter the larger indicator 72 starts its movement until at 12 o'clock it likewise has reached the highest point of its path of travel and remains there for the next six hours. Then the small indicator 71 again first moves downwards so that starting at 18 hours it is followed by the larger hour indicator 72. Such type hour marking represents the base and the tip of an imaginary arrow which migrates up and down at the scale analogous to the rising and setting of the sun. Since the tip always leads it will be apparent whether the arrow is in the course of rising or sinking. Therefore it is possible with only six subdivisions to differentiate 24 hours from one another.

The intermittent movement of the hour indicators 71 and 72 can be brought about by a random device suitable for this purpose.

Figure 17:
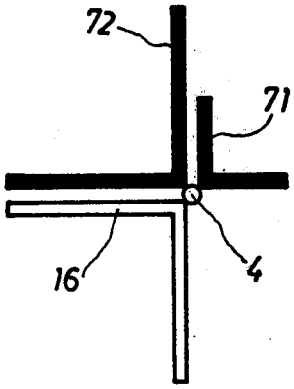
FIG. 17 is a plan view of a clock similar to that shown in FIG. 16.

The indicators 16, 71 and 72 advantageously can be also arranged in the manner shown in plan view in FIG. 17. The indicators 71 and 72 are constructed as horizontal arrows, the tips of which are directed towards the rod 1 carrying at the top the ball or sphere 4. These tips are secured to not particularly illustrated drive bands or belts. Since the minute indicator 16, viewed from the top, is also a right angle structure, each of the three indicators 16, 71 and 72 can be arranged in an imaginary quadrant around the rod 1, so that each of them can move along the rod 1 independent of the others.

Figure 18:
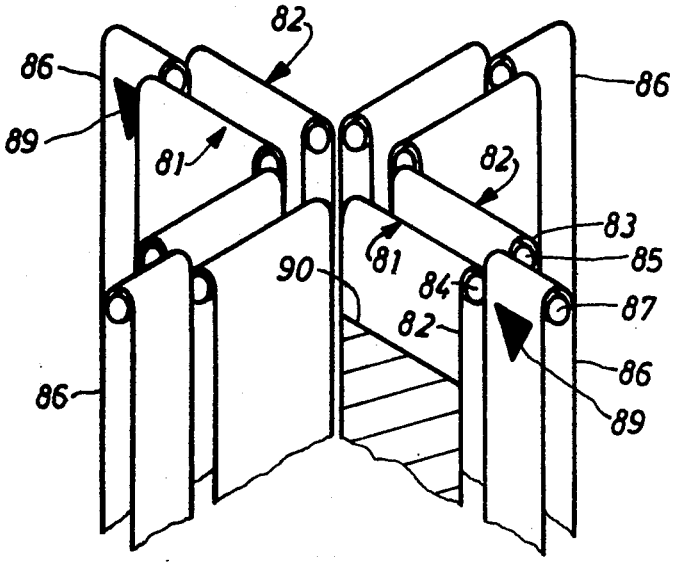
FIG. 18 is a fragmentary perspective view of still further embodiment of a clock constructed according to the invention.

The aforementioned two intermittently moving hour indicators can also be employed with a clock possessing a crosswise arrangement of time indicator units. In FIG. 18 there is illustrated such type clock. Each of the crosswise arranged units of this clock has two hour indicators 80 and 81 containing the bands or belts 82 and 83. These bands 82 and 83 are deflected at the top about the rollers 84 and 85 and at the bottom about similar rollers which here however have not been illustrated. At the bottom the drive of these bands 82 and 83 can occur for instance such as has been described in connection with FIG. 6. Merging with the hour bands 82 and 83 is a minute band or belt 86 which is deflected at the top about a roll or roller 87 and at the bottom over a further likewise not shown roll and from this location likewise driven. The upper deflection roller 87 is mounted upon a shaft (not shown) which is secured at one end at the center of the clock. The relevant minute band 86 carries in each instance an arrow-shaped minute indicator 89, the tip of which indicates the direction of movement of the minute bands 86. The relevant hour bands 82 and 83 are provided with a color along one-half of their length. This half of the corresponding band can be for instance black. The relevant boundary 90 between the colored part and the non-colored part of the band constitutes the hour indicator.

Figure 20:
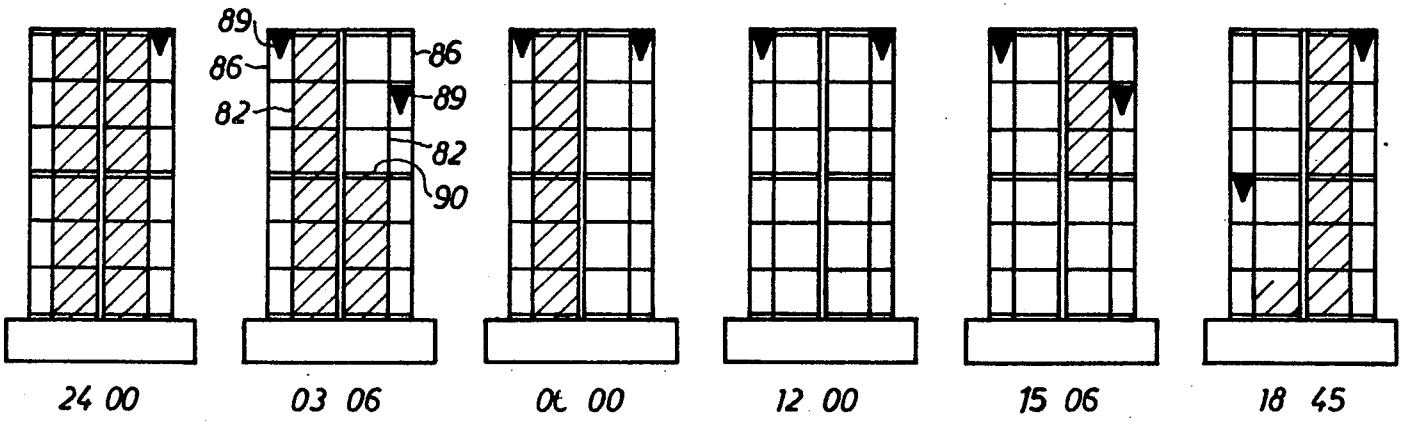

The relevant arm of this clock has associated therewith a scale, for instance as shown in FIGS. 11 and 15. In FIG. 20 there are illustrated a number of examples of time indications possible with this type of clock. The clock is only schematically shown in the illustration of FIG. 20, and the front arm of the clock has not been shown to preserve clarity in illustration. The time indication or time is read-off in each instance from two adjacently situated scales. In FIG. 20 reading of the time takes place by two arms of the crosswise constructed clock and which arms are located in the same plane. The time indication can however also be read-off by two arms which are at right angles to one another. For this purpose the relevant arm of the crosswise arrangement has two hour bands or belts 82 and 83 which are driven in such a manner that it is also possible to read the time from this direction. The time indications of FIG. 20 therefore are then equally applicable for this viewing direction.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A clock comprising at least one indicator device, said indicator device including an indicator, a substantially linear scale subdivided into time units, drive means for moving said indicator along the scale, said indicator being driven in accordance with the passage of time in its path of travel along said scale, said scale being one-dimensional, and said indicator being provided with an indicator mark indicating its direction of movement and being movable to-and-fro along said scale between both of its end points, said scale including a rod with scale markers arranged thereat, and an endless band for carrying the indicator, said rod being provided at its ends with drive and bearing means for rollers driving and deflecting the band.

2. A clock comprising at least one indicator device, said indicator device including an indicator, a substantially linear scale subdivided into time units, drive means for moving said indicator along the scale, said indicator being driven in accordance with the passage of time in its path of travel along said scale and being provided with an indicator mark indicating its direction of movement and being movable to-and-fro along said scale between both of its end points, said linear scale including a cylinder formed of transparent material for housing said indicator and said drive means, and scale markers in the form of circumferential rings carried by said cylinder.

3. A clock comprising at least one indicator device, said indicator device including an indicator, a substantially linear scale subdivided into time units, drive means for moving said indicator along the scale, said indicator being driven in accordance with the passage of time in its path of travel along said scale, said indicator being a substantially flat structure, wherein its length is comparable to its width, said scale being a likewise flat structure, and said indicator covers at least the central portion of the scale width, said drive means including an endless band trained about deflection and drive roll means, said indicator being guided at said endless band, said indicator having a substantially circular-shaped contour and being located at the center of the width of the band, the central line of the band coinciding with the central line of the scale.

4. A clock comrising at least one indicator device, said indicator device including an indicator, a substantially linear scale subdivided into time units, drive means for moving said indicator along the scale, said indicator being driven in accordance with the passage of time in its path of travel along said scale, said indicator being a substantially flat structure, wherein its length is comparable to its width, said scale being a likewise flat structure, and said indicator covers at least the central portion of the scale width, said scale including two adjacently situated components, each component being provided with a device for guiding an associated indicator, and said scale components being located between the run of an endless holder means for the guide device, and that at least one of the indicators covers the central portion of the therewith associated scale component.

5. The clock as defined in claim 4, wherein the scale components are located next to one another in a plane, deflection- and drive rolls means for both indicators arranged upon a common shaft, and wherein the drive roll means of both indicators are driven over separate paths from the drive means for the indicator.

6. The clock as defined in claim 5, comprising four indicator units which are arranged at right angles to one another and connected with one another at their longer sides, so that the individual indicator units form the arms of a cross.

7. A clock comprising at least one indicator device, said indicator device including an indicator, a substantially linear scale subdivided into time units, drive means for moving said indicator along the scale, said indicator being driven in accordance with the passage of time in its path of travel along said scale, said indicator being a substantially flat structure, wherein its length is comparable to its width, said scale being a likewise flat structure, and said indicator covers at least the central portion of the scale width, said indicator device including a lengthwise extending support plate provided at both ends with deflection roll means for a band carrying the first indicator and for a cable carrying a second indicator and drive rolls both for the band and for the cable, and the rolls associated with the cable being arranged at both ends of the relevant band roll and upon a shaft common therewith.

8. The clock as defined in claim 7, wherein the band is transparent and the support plate is provided with time markers.

9. The clock as defined in claim 7, wherein there are provided four of said indicator devices which are at right angles to one another so that they form the arms of a cross.

10. The clock as defined in claim 9, comprising a transparent cylinder surrounding the cross-shape arrangement of indicator devices.

11. The clock as defined in claim 10, wherein said scale includes time markers, and the cylinder carries the time markers.

12. The clock as defined in claim 9 wherein the indicator devices include plates held together by means of substantially cross-shaped clamping means.

13. A clock comprising at least one indicator device, said indicator device including an indicator, a substantially linear scale subdivided into time units, drive means for moving said indicator along the scale, said indicator being driven in accordance with the passage of time in its path of travel along said scale, said indicator being a substantially flat structure having a length and a width, said length being comparable to said width, said scale being a likewise flat structure and having a length and a width, said indicator covering at least a central portion of the scale width, at least a part of the scale being formed by an elongate frame having long sides and a width, the sides of the frame being connected with one another by means of rods extending transverse to the frame sides, and the indicator of flat structure at least covering the central portion of the frame width.

14. The clock as defined in claim 13, comprising two parallel spaced frames, guide means for the indicator being arranged between said frames.

15. The clock as defined in claim 14, wherein the indicator device comprises two indicators traveling over one another.

16. A clock comprising a fully exposed linear scale having a general axis extending the length thereof, said scale being viewable through an arc of 360 degrees about said general axis, said scale having ends and being subdivided into six substantially equal length sections, at least one indicator; said indicator including an indicator mark having means indicating its direction of movement relative to said scale, mounting means mounting said indicator mark for movement to and fro along said scale between its ends and in a continuous path, and drive means for driving said mounting means to effect movement of said indicator mark relative to said scale.

17. A clock as defined in claim 16 wherein said scale includes an elongated rod having thereon scale markers defining said scale sections, said mounting means is in the form of a continuous band, rollers supporting said band, bearing means at the ends of said rod rotatably supporting said rollers, and said drive means being at at least one end of said rod.

18. The clock as defined in claim 17 wherein said scale markers are in the form of sphere-like members, and wherein the uppermost and lowermost ones of said sphere-like members are provided with said bearing means.

19. The clock as defined in claim 16, wherein said scale is in the form of a cylinder formed of transparent material; said cylinder housing said at least one indicator, said mounting means and said drive means, and said cylinder carrying scale markers in the form of circumferential rings, said scale markers effecting said subdividing of said scale.

20. The clock as defined in claim 17 wherein said at least one indicator is formed as an arrow.

21. The clock as defined in claim 16 wherein there are three of said indicators including one minute indicator and first and second hour indicators, said first hour indicator being smaller than said second hour indicator and during movement is located either next to said second hour indicator or leads the same, and said drive means being connected to said hour indicators for intermittently moving said hour indicators along said scale.

22. The clock as defined in claim 21, wherein all of said indicators are, when viewed from above, a right angle structure, and each indicator is arranged in one of four imaginary quadrants around said scale.

23. A clock comprising a scale defined by two non-transparent plate portions arranged in a common plane, each plate portion having a front side and a rear side each subdivided into six substantially equal length sections representing time units to be read off, at least one indicator associated with each plate portion, means mounting said indicators for movement in a manner such that one of said indicators appears at the front side of the said scale when the other of said indicators is at the rear side of said scale.

24. The clock as defined in claim 23, wherein there are two of said scales arranged at right angles to one another and connected with one another in crossing relation, so that the individual plate portions form arms of a cross.

25. A clock comprising an indicator unit defined by two plate portions arranged in a common plane, and a transparent cylinder surrounding said plate portions and carrying scale markers in the form of circumferential rings which form a linear scale subdivided into six substantially equal length sections, said plate portions having front and rear sides, each of said plate portions being provided with at least one indicator, and means mounting said indicators for movement in a manner such that one of said indicators appears at the front side of the scale when the other of said indicators is at the rear side of said scale.

26. The clock as defined in claim 25, wherein there are two of said indicator units arranged at right angles to one another and connected with one another in crossing relation so that the individual plate portions form arms of a cross.

27. A clock comprising two flat scales arranged in a common plane, said scales being carried by at least one non-transparent plate, said scales each having a front side and a rear side subdivided into six substantially equal length sections representing time units to be read off, a pair of indicators associated with each scale, and means mounting each pair of said indicators for movement relative to said scales in a manner such that one of the indicators of the respective pair appears at the front side of the respective scale when the other indicator of that pair is at the rear side of the respective scale.

28. A clock comprising at least two bipartite scales which are flat and arranged in a common plane, said scales being carried by at least one non-transparent plate, each part of said bipartite scales subdivided front and back into six substantially equal length sections, each of said parts of said scales is provided with an indicator, and means for driving said indicators.

29. The clock as defined in claim 28, wherein there are two of said scales arranged at right angles to one another and connected with one another in crossing relation with the individual bipartite scales forming arms of a cross.

30. A clock comprising four indicator devices arranged crosswise, each of said indicator devices including two hour indicator bands and a minute band merging with said hour bands, said minute band being provided with a minute indicator indicating the direction of movement of said minute band, and said hour bands each being provided with a color along one-half of their length, a resultant boundary between the colored part and the non-colored part of each hour band constituting an hour indicator.

31. The clock as defined in claim 16 wherein there are three of said indicators including one minute indicator and first and second hour indicators, said first hour indicator being smaller than said second hour indicator and during movement is located either next to said second hour indicator or leads the same, and said drive means being connected to said hour indicators for moving one of said hour indicators along said scale from one end to the other for indicating times during a first six hour period and then moving the other of said hour indicators along said scale from the same one end to the other to indicate times during a second six hour period.

32. The clock as defined in claim 31, wherein all of said indicators are, when viewed from above, a right angle structure, and each indicator is arranged in one of four imaginary quadrants around said scale.

* * * * *